United States Patent [19]

Gonnai

[11] 4,246,857

[45] Jan. 27, 1981

[54] THREAD TENSIONING DEVICE FOR A SEWING MACHINE

[75] Inventor: Tohru Gonnai, Nagoya, Japan

[73] Assignee: Brother Kogyo Kabushiki Kaisha, Aichi, Japan

[21] Appl. No.: 132,540

[22] Filed: Mar. 21, 1980

[30] Foreign Application Priority Data

Mar. 28, 1979 [JP] Japan ..... 54-37482

[51] Int. Cl.[3] ..... D05B 47/04

[52] U.S. Cl. ..... 112/254; 242/153

[58] Field of Search ..... 112/254, 255, 59, 97; 139/216; 242/149, 153, 154

[56] References Cited

U.S. PATENT DOCUMENTS

| | | | |
|---|---|---|---|
| 257,052 | 4/1882 | Neilly | 112/254 |
| 3,347,195 | 10/1967 | Gegauf | 112/254 |
| 4,111,140 | 9/1978 | Gonnai et al. | 112/254 |

*Primary Examiner*—H. Hampton Hunter

*Attorney, Agent, or Firm*—Browdy and Neimark

[57] ABSTRACT

A thread tensioning device for a sewing machine, which is capable of automatically imparting, without any manual operation, a thread passing therethrough a suitable tension for the ordinary sewing, in accordance with the kind of thread as well as the thickness thereof. The device includes a pair of plate members closely confronted to each other for forming a narrow gap therebetween, being constantly urged by spring force acting at a concentrated point on one of the two members, and either one is provided with, on the inside surface thereof, a plurality of grooves formed perpendicularly to the direction of the thread running, each groove having a sharpened edge between the side surface of the groove facing the thread advancing direction and the thread engaging surface of the plate member for imparting a resistance independent of the spring force to the thread according to the surface condition thereof peculiar to each kind of threads.

10 Claims, 13 Drawing Figures

THREAD TENSIONING DEVICE FOR A SEWING MACHINE

FIELD OF THE INVENTION

This invention relates to a thread tensioning device for a sewing machine, and more particularly to a thread tensioning device which is capable of automatically imparting an appropriate tension to the thread in accordance with the kind of thread at each replacement thereof.

BACKGROUND OF THE INVENTION

In well-known thread tensioning devices in the ordinary sewing machines for imparting tension to the upper thread, the tension imparted to the thread, when the thickness or size of a thread is changed by replacement of threads, is rarely altered automatically. So it is required, for making a beautiful stitching wherein a concatenation is formed almost midway in the direction of the thickness of a work fabric to be sewed, by a well balancing or harmony of tension of an upper thread and a lower thread, to manually operate the thread tensioning device at each replacing of the upper thread for suitably adjusting the tension given to the upper thread. This adjusting operation of the device needs in addition a trial sewing for confirming whether the degree of tension is appropriate, being a time-consuming work even for a skilful operator. For the unskilled operators this adjustment operation is a far troublesome work beyond imagination.

As a device of prior art for eliminating the above-mentioned disadvantages U.S. Pat. No. 4,111,140 applied by the same applicant as this application and another person, as a co-applicant, can be cited. In the device indicated hereabove, a suitable tension can be automatically imparted to a running thread which passes through the device, for forming a good looking stitches in an ordinary sewing operation, in accordance with the thickness of the thread. This prior art is very effective, so far as the simplification problem of an automatical adjustment of the thread tension is concerned. This inventor came across a new problem during his strenuous experiments for realizing the above identified invention into the production line, that is a problem which is concerned to an adjustment of tension in accordance with the variation of the thread kind. In case of changing the kind of threads in the known upper thread tensioning devices of the ordinary sewing machines, it is a well-known fact that the tension given to the thread must be adjusted by all means even when the thickness of the thread is identical. With the device disclosed in the above U.S. Pat. No. 4,111,140 the situation is the same, i.e., an adjustment is needed at the replacement of threads of different kinds, while no adjustment is required at the replacement of threads of different thickness. True simplification or provision of a handy device for thread tensioning can be realized only by solving this problem, that is providing a tensioning device capable of automatical tension adjustment not only for the thread charge between different thickness but also for the thread change between different kind.

SUMMARY OF THE INVENTION

This invention was made from such a background and proved to be fully effective after a series of laborious sewing experiments. A primary object of this invention is therefore to provide a thread tensioning device capable of automatically imparting the running thread which passes through the device a suitable tension, according to the kind of threads, for forming good looking stitches in the ordinary sewing operation.

The thread tensioning device according to the present invention preferably comprises a pair of plate members, mounted in the machine frame, disposed in confrontation to each other under a concentratedly applied spring force thereon, thread guiding means for guiding a thread from a thread supply so as to be passed between the plate members, substantially along the longitudinal direction of the plate members, and gap forming means for forming between the plate members a narrow gap, extending along the thread path, of substantially wedge shape. On one of the plate members a plurality of grooves are formed substantially perpendicularly to the thread path, and an open edge portion of each of the grooves on the side facing opposite (reverse) to the advancing direction of the thread are made sharp. The sharpened edge portion contacts with the thread running (passing) between the pair of plate members, and so imparts the thread, while the same is running over the edge, a passing resistance, which is entirely independent of the force of the spring, according to the surface condition of the thread. This passing resistance acts on the thread as an opposing resistance to the advance of the thread in accordance with the kind of threads which pass through the gap between the plate members. For example, in case of an ordinary cotton thread the resistance which it meets when passing over the sharpened edge portion is relatively large because of the fluff seen much on its surface. On the contrary a less fluffy silk thread receives a much less passing resistance. As a result, the tension given to a passing thread largely varies automatically according to the kind thereof, in response to the change of the passing resistance which takes place there for each different kind of thread passing through the thread tensioning device. It has enabled the elimination of manual operation of the tension adjustment, in case of changing of thread kinds, which had been regarded as inevitable for forming good looking stitches.

And, as the narrow wedge shaped gap is formed between the pair of plate members, the passing resistance applied to the running thread through the gap is also automatically determined according to the thickness of the thread. Therefore any thread running therethrough needs no manual adjusting. operation for the tension which should be imparted thereto, regardless of the thickness as well as the kind thereof. It can be said another object of this invention is to provide a thread tensioning device which allows an entire elimination of manual thread-tension-adjusting operation for forming good looking stitches in an ordinary sewing operation.

In an embodiment of this invention, the pair of plate members are not completely contacted with each other on the thread path even when no thread is running therebetween, but held in the mutual confrontation with the wedge shaped gap kept between the two. And the gap is formed broader at the inlet side of the thread path and narrower at the outlet side thereof. The variation of the thread tension which takes place in response to the difference of the thread thickness becomes therefore more remarkable in this embodiment, in comparison to the disclosure in U.S. Pat. No. 4,111,140 wherein the pair of plate members are contacted at the outlet side of the thread path when no thread is running therebetween. Besides, an idle movement or a vibration of one plate member of the two during the sewing operation can be prevented to the largest possible extent in this invention. It is therefore still another object of this invention to provide a thread tensioning device which is capable of automatically varying the tension given to the thread, at each replacement of the threads, in accordance with the kind and thickness of the thread replaced, and of stably imparting the tension to the thread suitable for forming a desired stitch throughout the sewing operation.

Other objects and advantages of this invention will be made more clearcut from the study of this description in conjunction with the appended drawings.

BRIEF DESCRIPTION OF THE DRAWINGS

Drawings are for illustrating embodiments which has realized the invention in a thread tensioning device of a household sewing machine, in which.

DETAILED DESCRIPTION OF THE PREFERRED EMBODIMENTS

Figure 1:
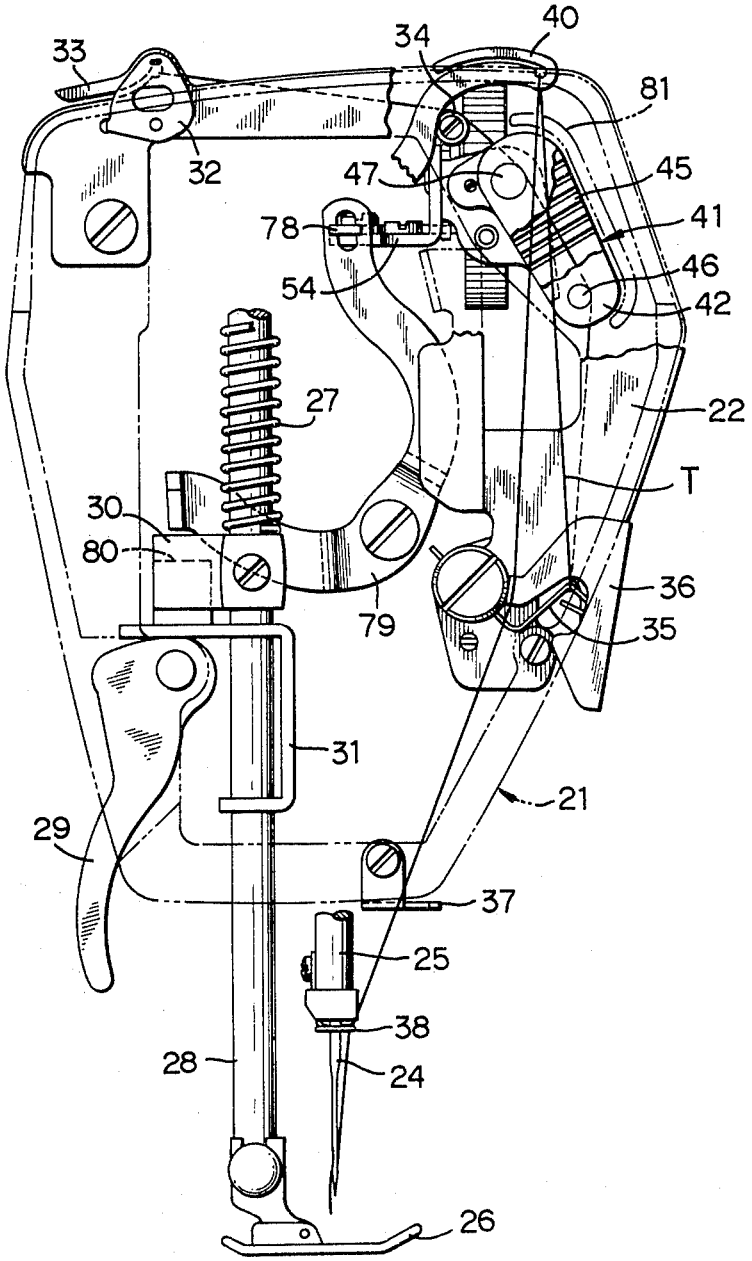
FIG. 1 is a side view, partially broken away, of a machine head for showing the attached position of the thread tensioning device to the machine head, wherein a cover plate is removed.
Figure 2:
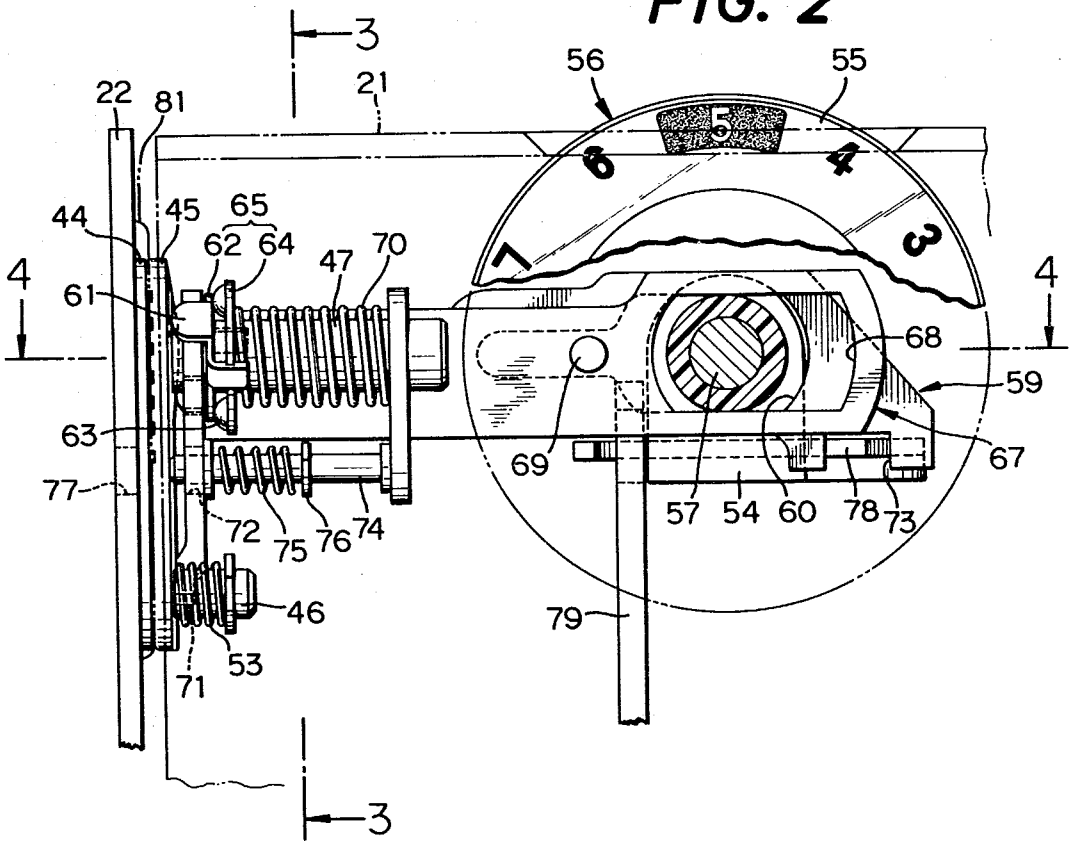
FIG. 2 is an enlarged elevational view of the thread tensioning device with the machine frame being removed.
Figure 3:
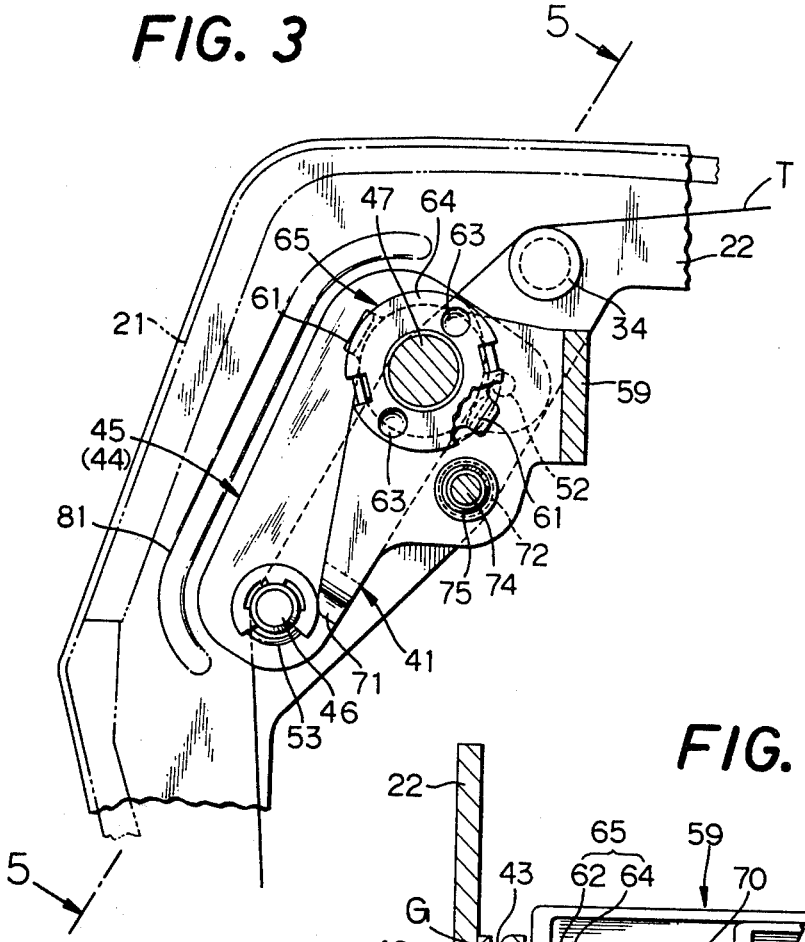
FIG. 3 is a sectional view taken substantially along the line 3—3 of FIG. 2.

A machine frame comprises a hollow arm 21 and a known cover plate 23 openably attached for covering an opening portion on one end of the hollow arm 21. An attaching plate 22 is fixed to the opening portion of the hollow arm 21. Inside the cover plate 23 a well-known needle bar 25 which carries a needle 24 at the lower end thereof and a pressure bar 28 which is provided with a pressure foot 26 fixed at the lower end thereof are mounted. The needle bar 25 is able to perform endwise reciprocation in timed relation with the rotation of a main shaft (not shown) in a well-known manner. The pressure bar 28 is usually biased downward by the action of a compression spring 27. An operated lever 29 for lifting the pressure bar is confronted from lower side, via an actuating arm 31 which is slidably fitted on the pressure bar 28, to the projection portion of a block 30 secured to the pressure bar 28. When the operated lever 29 is rotated upwards the pressure bar 28 is lifted up against the spring force of the pressure spring 27. On the attaching plate 22 are secured, for guiding thread T drawn from a supply of upper thread, a first thread guide 33, to which a resilient thin plate 32 is press-contacted, a guide pin 34, and a second thread guide 36 having a check spring 35. Furthermore a third thread guide 37 is secured to the hollow arm 21, and a forth thread guide 38 is secured to the lower end of the needle bar 25. And the cover plate 23 is formed with a cutaway portion 39 (see FIG. 4) neighboring with the attaching plate 22. A thread take-up lever 40, which is reciprocally movable in a well-known manner, is protruded outside at one end thereof having a thread retaining eyelet through the cutaway portion 39 at the almost uppermost position thereof.

A thread tensioning device 41 in accordance with this invention is disposed on a path of the thread. A detailed description about the mutual relation between the passing upper thread and the device for imparting tension thereto will be developed hereunder with reference to FIGS. 2–6.

A pair of elongated rigid plate members 44, 45 having respectively a thread engaging surface 42, 43 thereon are idly fitted on a pin 46, which is secured to the attaching plate 22, at a respective one end portion thereof in a mutually confronted manner. One plate member 44 which is adjacent to the attaching plate 22 is secured to, by a supporting shaft 47, the attaching plate 22 in a closely contacted manner thereto. The other plate member 45 is also idly fitted on the supporting shaft 47, so it is movable in the axial direction of the supporting shaft 47 and the pin 46, being guided by them both. The plate member 45 is also slightly movable in a slant manner, that is, to become slightly unparallel to the plate member 44. And both mutually confronted thread engaging surfaces 42, 43 of the plate members 44, 45 are smoothly finished. On the thread engaging surface 43 of the movable plate member 45 a plurality of grooves 48 are formed extending in a perpendicular direction to a plane including axes of both the supporting shaft 47 and the pin 46. Either side surface 49, 50 of each groove 48 (see FIG. 9) crosses almost perpendicularly the thread engaging surface 43. One edge 51 of the groove 48, which is formed on the boundary of the side surface 50 and the thread engaging surface 43, is specially sharpened or made sharp so as to be less than 0.1 mm in the radius. The plate member 45 is confronted (faced) to an adjusting screw 52 screwed into the attaching plate 22 and is biased toward the plate member 44 due to weak biasing action of a coil spring 53 disposed on the pin 46, consequently being abutted on the adjusting screw 52.

On a bracket 54 secured to the hollow arm 21 a manual dial 56 having an indicating plate 55 on the front face is rotatably attached with a pivot shaft 57. The dial 56 is partly exposed (visible) through an opening on the hollow arm 21, and provided with a cam groove 58 on the rear surface thereof. A releasing plate 59, which is slidably fitted on the supporting shaft 47 at one end thereof, is fitted on a boss portion of the manual dial 56 at an opening 60 formed on the other end thereof, being movable along the supporting shaft 47. A spring receiver 65 composed of a washer 62 having a pair of projections 61, 61 and another washer 64 having a pair of spherical portions 63, 63, is mounted on the supporting shaft 47, being positioned by a fitting of one of the projections 61 into an opening 66 formed on the releasing plate 59. An actuating plate 67 which is slidably fitted on the supporting shaft 47 at one end thereof is fitted at the other end thereof on a boss portion of the manual dial 56 at an opening 68, and a pin 69 secured on the middle portion thereof is fitted in the cam groove 58 of the manual dial 56. So the actuating plate 67 is movable, when the manual dial 56 is rotated, along the supporting shaft 47 in accordance with the shape of the cam groove 58. A coil spring 70 disposed on the supporting shaft 47 so as to be interposed between the actuating plate 67 and the spring receiver 65 is strong in its spring force, which concentratedly acts, via the projections 61, 61 of the spring receiver 65 on the movable plate member 45.

On one end of the releasing plate 59 a pressure portion 71 confronting to the rear side of the plate member 45 and an opening 72 opened toward the attaching plate 22 are formed, and on the other end a notch 73 is formed. A shaft pin 74 is fixed to the actuating plate 67 for extending through the opening 72. About the shaft pin 74 a coil spring 75 is wound, and when the actuating plate 67 is moved leftwardly (in FIG. 2) beyond a certain predetermined position the coil spring 75 is compressed by a stop ring 76 fixed on the shaft pin 74 for biasing the releasing plate 59 to urge the plate member 45 at the pressure portion 71. On the attaching plate 22 a hole 77 is formed at a position corresponding to the shaft pin 74 for allowing the movement of the same thereinto. On the bracket 54 a two-armed lever 78 is pivoted, one arm thereof being fitted into a notch 73 of the releasing plate 59. A shift lever 79 is pivotably disposed in the hollow arm 21, one end thereof being confronted from above to a rising portion 80 (see FIG. 1) of the actuating arm 31, and the other end thereof being operatively connected to the other arm of the two-armed lever 78. When the operated lever 29 is manually operated to lift up the pressure bar 28 the shift lever 79 is rotated by the rising portion 80, rotating the two-armed lever 78 counterclockwise in FIG. 4. The releasing plate 59 is consequently moved rightwardly (in FIG. 4) to release the spring force of the coil spring 70, which has been biasing the plate member 45 via the spring receiver 65, from the plate member 45.

A thread T drawn out of an upper thread supply is led between, being guided by the first thread guide 33 and the guide pin 34, the two plate members 44, 45, before being bent around the supporting shaft 47 and getting out of the plate members with the guide of the pin 46; the thread T is further turned back upwards, guided by the second thread guide 36 to get through a thread retaining eyelet of the thread take-up lever 40 before returning downwards, via the second thread guide 36 again and the third and fourth thread guides 37, 38, to reach an eyehole of the needle 24. The thread T runs through between the aforementioned plate members 44, 45 along the longitudinal direction thereof by the guide of the guide pin 34, the supporting shaft 47 and the pin 46.

Figure 5:
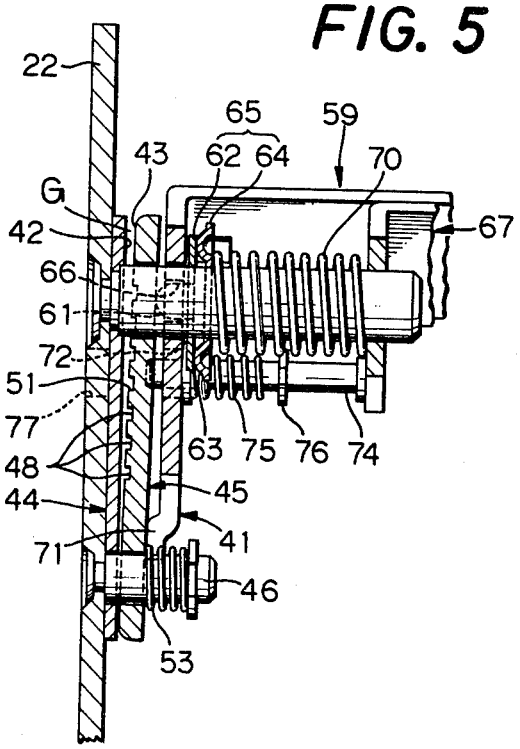
FIG. 5 is a sectional view taken substantially along the line 5—5 of FIG. 3.
Figure 4:
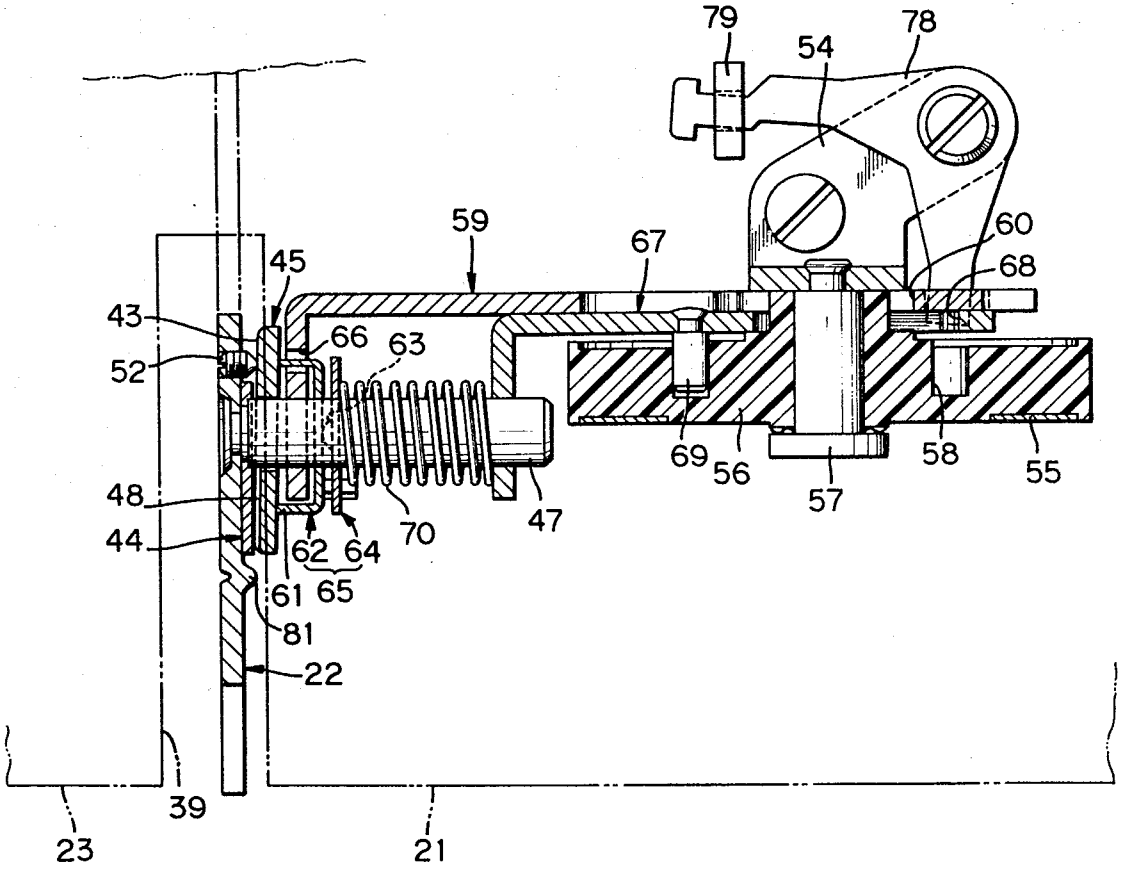
FIG. 4 is a sectional view taken substantially along the line 4—4 of FIG. 2.
Figure 6:
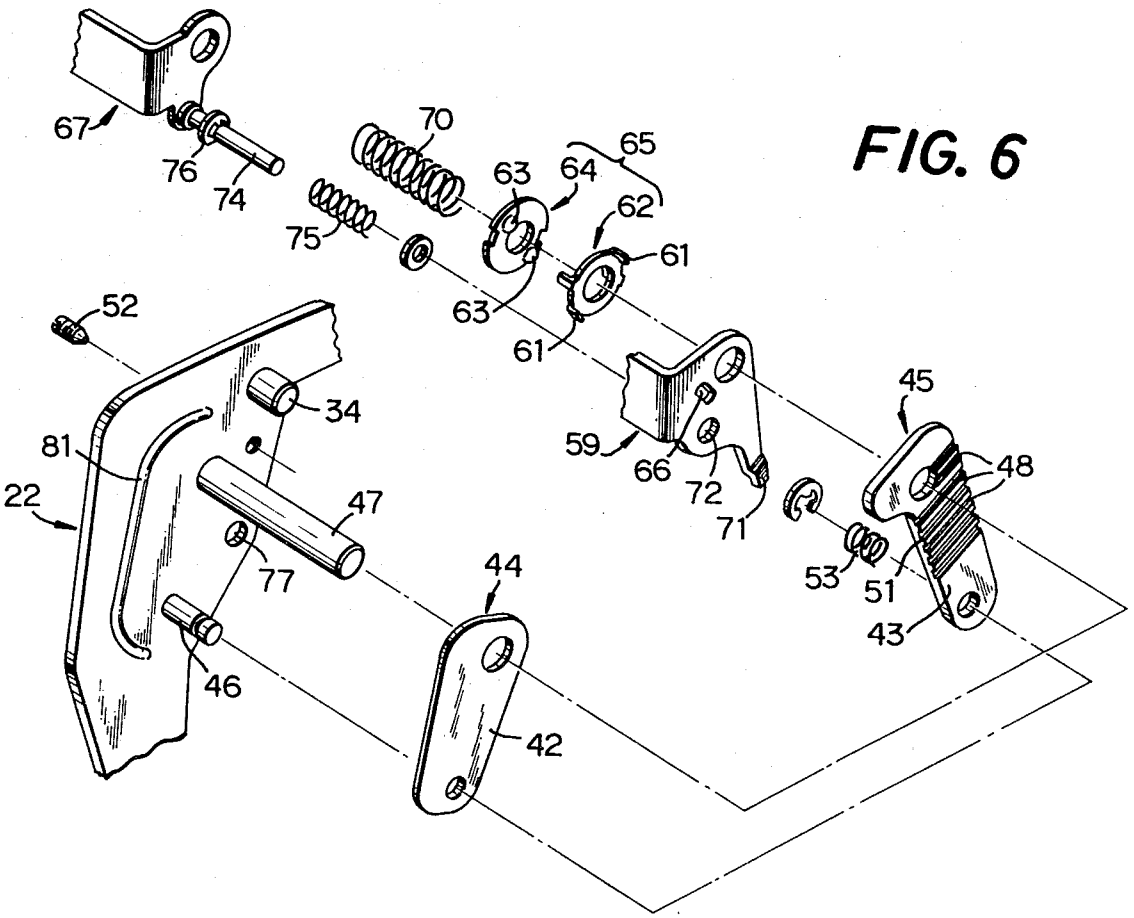
FIG. 6 is an exploded perspective view for showing parts of the device.
Figure 7:
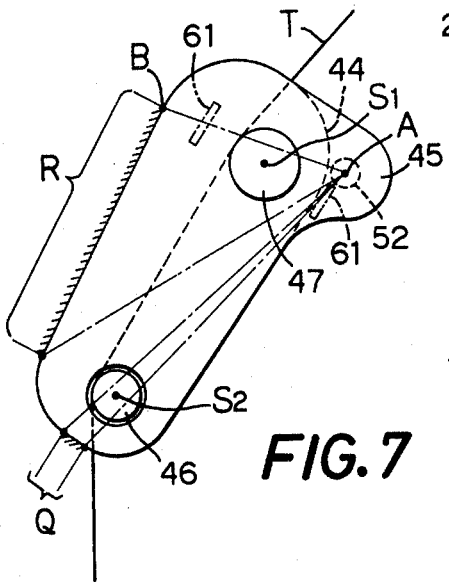
FIG. 7 is a schematic view for explaining the contact condition of a pair of plate members.

Regarding the arrangement relation of the pair of projections 61, 61 on the spring receiver 65 and the adjusting screw 52 to the movable plate member 45 will be explained next, with reference to FIG. 7. Either tip of the pair of projections 61, 61 is located at an identical distance from the axis $S_1$ on a line which passes through the axis $S_1$ and crosses at right angle a line linking the axis $S_1$ of the supporting shaft 47 and the axis $S_2$ of the pin 46. So the acting position of the coil spring 70 on the plate member 45 equivalently coincides with the axis $S_1$. And a tip A of the adjusting screw 52 is located biased to the side of the upper thread supply in relation to the line linking the corresponding top end of the pair of projections 61, 61, and inner-sidedly located in the hollow arm 21 in relation to the line linking the axes $S_1$ and $S_2$. The plate member 45 is therefore contacted, under the action of the coil spring 70, with the confronted plate member 44 along the straight-lined range R on its periphery to form a gap between the two plate members 44, 45. It will be fully and easily understood that the gap is a very narrow one of substantially wedge shape diverging in an almost perpendicular direction to the path of the thread T toward the inner side of the hollow arm 21, as can be seen in FIG. 4, and also a very narrow one of substantially wedge shape diverging in an almost parallel direction to the path of the thread T toward the nearer side to the upper thread supply, as can be seen in FIG. 5.

Figure 10:
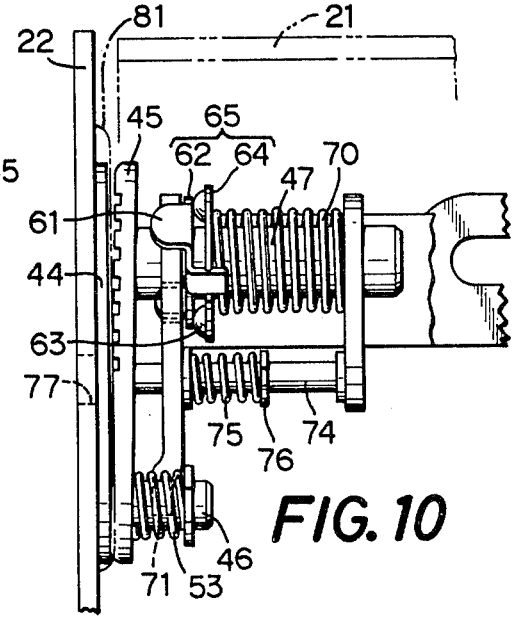
FIG. 10 is an elevational view, partly corresponding to FIG. 2, of the device for explaining the positional relation of parts wherein the pressure foot lever is lifted.

On the other hand the acting point of the coil spring 53 wound about the pin 46 against the plate member 45 equivalently coincides with the axis $S_2$. The spring force of the coil spring 53 is far weak than that of the coil spring 70, being almost negligible while the latter is acting. When the spring force of the coil spring 70 against the plate member 45 is released due to the operation of the releasing plate 59, however, the coil spring 53 becomes effective for letting the plate member 45 swing, relatively to the confronted plate member 44, on the tip A of the adjusting screw 52 as a fulcrum, with a result of causing a contact of both plate members 44, 45 at another straight-lined range Q. The plate member 45 is at this stage separated from the plate member 44 (see FIG. 10) at the range R to make insertion of the thread T between both plate members 44, 45 easier when the thread setting is executed. A protrusion 81 formed on the attaching plate 22, on the front side of the fixed plate member 44, is helpful in guiding the thread T when it is inserted between both plate members 44, 45. And in the ordinary sewing operation, the thread T drawn out from the supply source in relation to the vertical reciprocating movement of the thread take-up lever 40 is allowed to pass smoothly between the two plate members 44, 45 and can be prevented from getting outside the both members even when the thread T is slackened.

Figure 8:
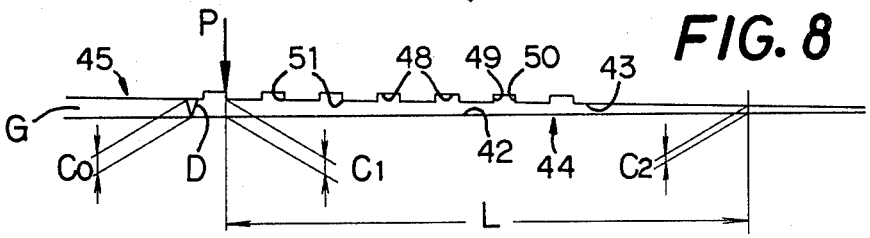
FIG. 8 is a diagram for explaining the fundamental concept of the device under a condition wherein no thread exists between the plate members.

Regarding the gap G between the plate members 44, 45 through and along which the thread T passes will be detailed with reference to FIG. 8, in which the gap G is diagrammatically shown with no thread being inserted therein. Both plate members 44, 45 are not contacted along the thread path, leaving respectively a gap $C_1$ and $C_2$ at the thread contacting points to the supporting shaft 47 and the pin 46, as can be seen in the Figure. In this embodiment the gap $C_1$ is of approximately 0.2 mm width and $C_2$ of approximately 0.14 mm width and the distance L between the two contacting points is about 23.5 mm long. So the gap G formed between the two thread engaging surfaces 42, 43 of both plate members 44, 45 as the path of the thread T is a very narrow one diverging with a small angle toward the inlet side of the thread T. The adjusting screw 52 functions as an adjustable projection for forming the gap G of wedge shape, allowing a suitable adjustment of the diverging angle of the wedge shaped gap through advancing and retracting thereof. And on the plate member 45 the spring force of the coil spring 70 is acted concentratedly, by way of the pair of projections 61, 61 of the spring receiver 65, which is shown in FIG. 8 as P. This acting point P corresponds to the position where the upper thread T crosses a straight line linking the pair of projections 61, 61. It is therefore assumed theoretically that an imaginary projection D essentially exists for forming an fixed gap $C_o$ at a position where the thread T intersects (crosses) a straight line linking the tip A of the adjusting screw 52 and one end point B of the straight-lined range R. The plate member 45 can be thought to be movable on the imaginary projection D as a fulcrum. Strictly speaking, the position of the imaginary projection is slightly moved to the inlet side of the thread T, when the thread is inserted between the plate members 44, 45, and consequently the width of the gap $C_o$ is slightly varied, although it is practically negligible.

When the upper thread T passes through such a gap G the plate member 45 affects the upper thread T according to the so to speak principles of lever and fulcrum, wherein the fulcrum lies at D and the spring force P is assumed to be the force acted on the point of force. In other words, an appropriate spring force is imparted to the upper thread T according to the thickness of the thread T. In this regard the specification of the above-mentioned U.S. Pat. No. 4,111,140 will be helpful for a deeper understanding. What must be paid attention in this respect is that a thread is a non-rigid matter and consequently squeezed between the two plate members 44, 45 in the range varying in accordance with the thickness thereof. In other words, the plate member 45 affects the thread T throughout the above-mentioned variable range. Variation of the thickness of the thread passing through between the two plate members 44, 45 invites the corresponding variation of the acting range of the spring force, resulting in variation of the frictional resistance applied on the thread T. In case of a particularly thick thread a resistance from a deformation of the thread, while it passes the gap $C_o$, is added. The passing resistance acted on the upper thread is, through the resistance due to the friction and the deformation, automatically determined in response to the thickness of the thread. The thicker the upper thread T passing through between the two plate members 44, 45 is, the greater becomes the tension imparted to the same.

Figure 9:
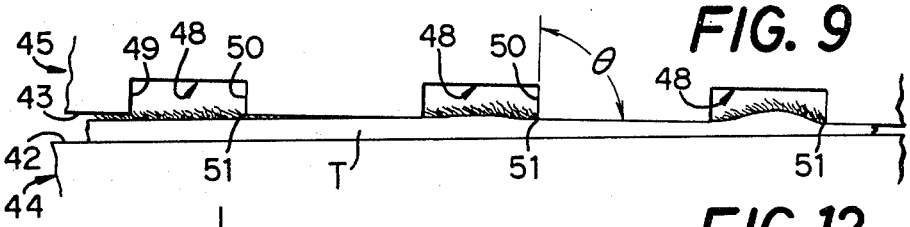
FIG. 9 is a partly enlarged corresponding view of FIG. 8 for explaining the operational condition of the device with a running thread therein.

Incidentally the coefficient of friction of a thread against a metal plate is not identical in cotton and in silk. In conventional devices the tension imparted to the thread passing therethrough can be varied more or less according to the kind of threads, but the variation is by no means sufficient for the practical needs in making a desired stitches. The operator had to inevitably operate the tensioning device for adjusting the tension in each change of the thread sort. In the embodiment a plurality of grooves 48 formed on the thread engaging surface 43 of the plate 45 effectively impart a passing thread suitable passing resistance according to the kind of threads with a plurality of sharpened edges formed on each opposing side surface of the grooves to the advancing direction of the thread. With reference to FIG. 9 detailes of this matter will be described hereunder.

Each of the grooves 48 is almost perpendicular to the running direction of the thread T. Out of either side surface 49, 50 of each groove 48, one side surface 50 opposing (reversing) to the advancing direction of the thread is provided with a sharp edge 51 extending along the boundary with the thread engaging surface 43. As there is a gap G of wedge shape between the two plate members 44, 45, each edge 51 is differently distanced from the confronted thread engaging surface 42 of the plate member 44. No matter what thickness of a thread passes through the gap G, at least one edge 51 can be touched only the surface of the thread without deforming the same by squeezing. Among the usually employed kinds of threads, cotton thread is more fluffy than silk thread. According to the degree of the fluffiness the passing resistance applied on the thread at the edge 51 varies. The fluff of the thread T is stroked down (smoothed down), when the thread passes through the gap G, by virtue of the edge 51, in an opposing direction to the advance of the thread T. To the more fluffy thread the greater passing resistance is applied at the edge 51. Consequently in a comparison of the ordinary cotton thread and the ordinary silk thread, the former receives greater resistance at the edge 51, even when the thickness of two threads are identical. It can be easily proved in an experiment using a micrometer caliper, wherein cotton and silk threads of an identical thickness is passes through a certain narrow gap formed between a pair of contacting tips.

Figure 11:
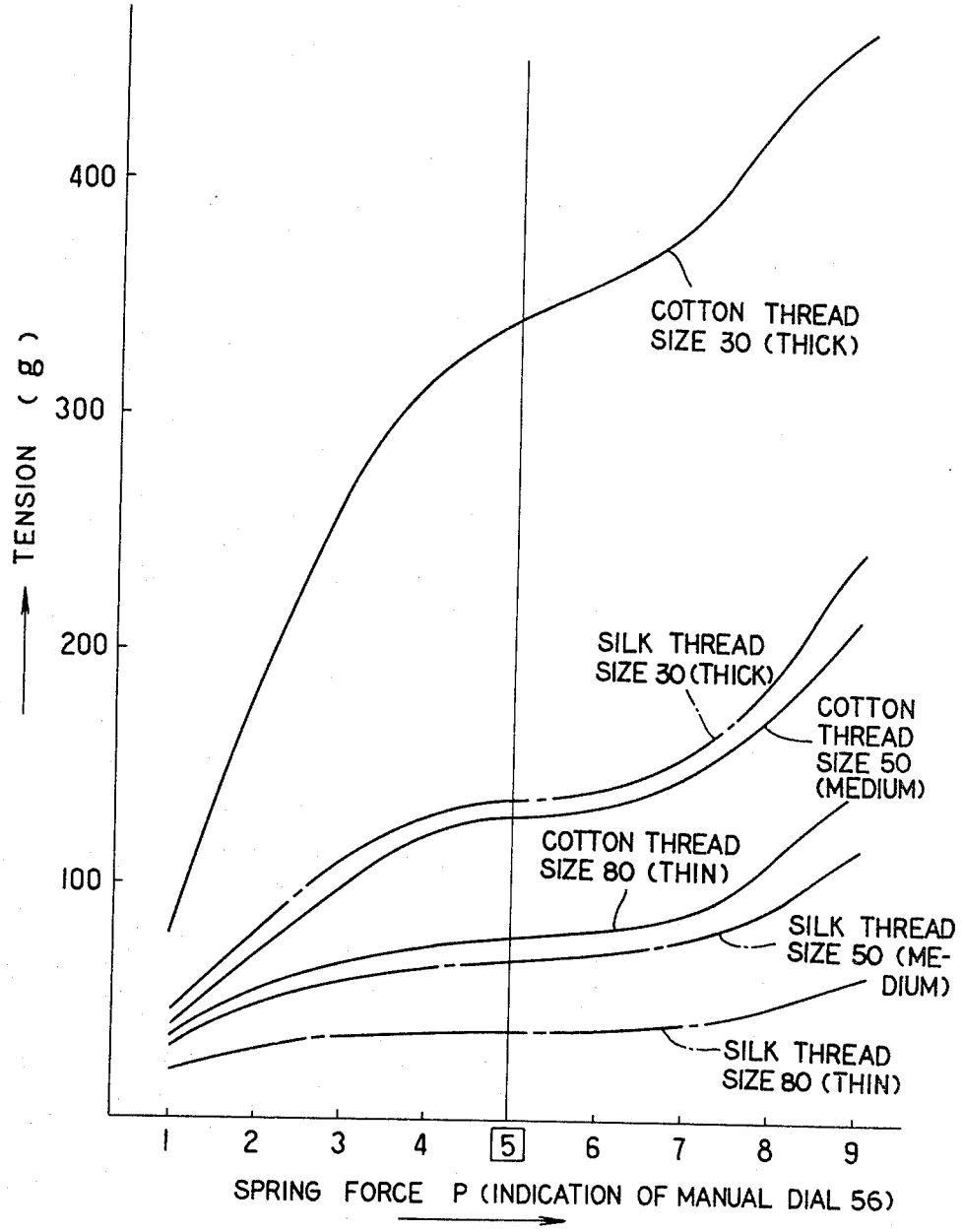
FIG. 11 is a graph for showing the amplitude of the tension given to the running thread through the device.

By means of combined applying of the passing resistance given to the passing thread by the edge 51 and the frictional resistance given thereto between the thread engaging surface 43, 44 due to the spring force P, a thread passing through this embodiment of thread tensioning device can be imparted an appropriate tension. In FIG. 11 the amplitude of tension imparted to threads, in accordance with the thickness and kind thereof, is shown as a graph. On the abscicca of the graph the spring force P is plotted in relation to the indication of the manual dial 56. As can be clearly observed from the graph, there is a great difference of tension between ordinary cotton thread and ordinary silk thread irrespective of their similar thickness. In an ordinary sewing operation adjustment of the spring force P so as to correspond to the indication "5" of the manual dial 56 is sufficiently effective for forming beautiful or good looking stitches. Incidentally it is well-known that the tension of the lower thread needs little adjustment, even when the thickness and kind is varied.

In ordnary cotton threads much fluff is usually observed, there are however some specially processed cotton threads to the least possible fluffiness. Such a less fluffy cotton thread is weak, in comparison to the ordinary cotton threads, in the resistance against tightening of the stitches; so it is necessary in the conventional tensioning devices to manually reduce the tension imparted to the upper thread by the very device. IN this embodiment, however, the edge 51 is capable of detectin (sensing) the surface condition of the passing thread and of imparting a corresponding resistance to the thread in accordance with the surface condition thereof. So the tension imparted to a cotton thread, when it is less fluffy, can be automatically reduced, requiring no manual operation. Besides, some threads have on the surface thereof remarkable unevenness and some don't according to the degreeof ply or twist applied thereon. Such kind of surface condition of threads can also be sensed by the edge 51. As a device for sensing the surface condition of threads and imparting a necessary tension, entirely independent from the spring force P, in response to the sensed condition, the edge 51 may be effectively utilized.

In case wherein the lower thread is drawn up largely above the work fabric for forming special stitches, for example a shell-tack, by means of particularly imbalancing (disharmonizing) the relation between the lower thread and the upper thread, a manual operation is needed just like in the conventional machines. In that case the manual dial 56 is operated or adjusted, from the ordinary operational position where the indication "5" with an indicator (not shown) on the hollow arm 21 to another position where any of the indications 7–9 agrees with the indicator. This operation moves the actuating plate 67 leftwards in FIG. 2 to further compress the coil spring 70 and compress at the same time another coil spring 75 by way of a stop ring 76. It increases on one hand the spring force P and elastically biases on the other hand the plate member 45 in the vicinity of the pin 46, by the pressure portion 71 of the releasing plate 59, onto the plate member 44. In this way the tension of the thread T passing through between the two plate members 44, 45 is remarkably increased. The coil spring 75 warrants (ensures) the remarkable tensing up of the thread T. Variation of the spring force P owing to an operation of the manual dial 56, while the coil spring 75 is inoperative, is not great, which effectively facilitates a delicate tension adjustment at an oridinary stitch formation.

The upper thread tensioning device of this invention, as can be fully understood from the above description, makes it possible even for unskilled operators to automatically impart a thread necessary tension suitable for the desired stitch formation, according to the kind and thickness thereof, by only operating the machine with the manual dial 56 being set at the standard position where the indication "5" is agreed with the indicator. This device is capable of stably imparting the suitable tension mentioned above to a passing thread T, because both plate members 44, 45 are not contacted to each other on he thread path even where the two plate members are most approached to each other, and the plate member 45 is appropriately swingable according to the thickness of the passing upper thread T. For the skilled operators, manual operation is also permissible just like in the conventional machines. Furthermore, the movable plate member 45 is swung in linkage with the lifting up of the pressure-foot 26 for separating the two plate members 44, 45 from each other on the inlet side of the upper thread T, which facilitates the insertion of the thread T between the two plate members 44, 45 in case of thread setting; and the movable plate member 45 is pressedly abutted on the fixed plate member 44, when the pressure-foot 26 is depressed, on the inlet side of the upper thread T, which prevents the upper thread T from getting out of the normal thread path between the two plate members 44, 45.

It is possible to form the thread engaging surface 43 of the plate member 45 into a curved plane of a very large radius of curvature instead of a flat plane. And the edge 51 is formed, as mentioned earlier, between the thread engaging surface 43 and the side surface 50 perpendicularly intersecting the former, wherein the contained angle $\theta 90°$ or so is most appropriate with a permissible allowance up to approximately 100° as a sufficiently effective limit. In any case the edge must be sharpened such as being less than 0.1 mm in the radius. If and when the edge is dull the sensing capability for the surface condition of threads is deteriorated.

Figure 12:
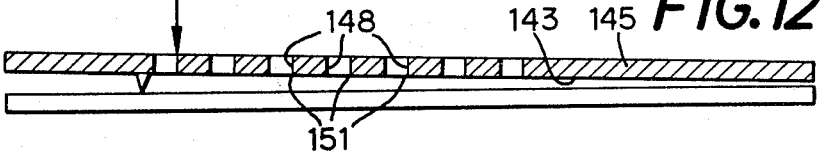
FIGS. 12 and 13 are all diagrams for respectively explaining another embodiment of this invention, corresponding to FIG. 8.

Some of other embodiments of this invention will be outlined hereunder. In FIG. 12 an edge 151 situated on the thread path is formed between an inner surface of an opening or a hole 148 bored in a plate member 145 and a thread engaging surface 143. While the groove 48 is formed, for example, by machining utilizing a milling cutter and the edge 51 is finished by a surface grinding or polishing of the thread engaging surface 43, the opening (hole) 148 may be made by a press-punching, followed by a similar surface grinding or polising to finish the edge 151 sharp. As can be surmised from this embodiment a sharp edge facing reverse to the thread advancing direction may be formed from a recess.

Figure 13:
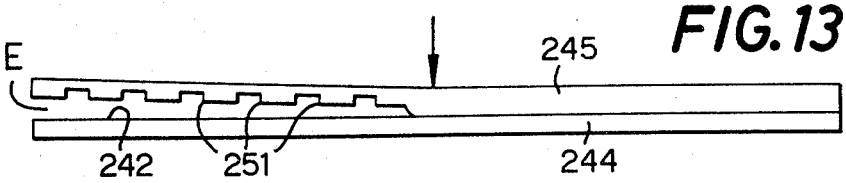

Although in the above-mentioned embodiments a small gap of wedge shape is formed between the two plate members against the spring force with the object of automatically varying the tension given to a thread in response to the thickness thereof, another modified embodiment as shown in FIG. 13 is possible when only a remarkable variation of tension given to a thread according to the kind of threads, which may be said the principal object of this invention, is aimed. In this modification case a pair of plate members 244, 245 are partly surface-contacted due to a spring force, and a gap E is made on the inlet side of the thread without resisting the spring force at all, and a plurality of sharpened edges 251 are formed on the thread engaging surface of the plate member 245 with each different distance from the thread engaging surface 242 of the plate member 244. It ensures that a passing resistance is given in accordance with the surface condition of the thread irrespective of the thickness of the thread passing the tensioning device. In other words, even only one of the edge of this sort will suffice, so long as the thickness of the thread passed there is constant.

In the above described embodiments the edge 51, 151, and 251 is formed on only one plate member, it may also be formed on both plate members with more effectiveness. Although the coil spring 70 is utilized for imparting tension to a thread owing to the frictional resistance of the thread, it may be replaced by an electromagnetic solenoid. In that case an armature of the solenoid functions to urge one plate member 45 toward the other plate member 44, and the urging force may be adjusted by means of changing the magnitude of the electric current supplied to the solenoid. And this invention is applicable or realizable to industrial machines, not limited to household sewing machines, such as a hemstitching machine, i.e., to a tensioning device for the upper thread or the lower thread thereof. Furthermore, the fixed plate member may be made integrally with the attaching plate 22. Then a part of the attaching plate 22 is pressed to have a relieved or bulged portion to function as the fixed plate member 44.

Some preferred embodiments of this invention eliminate the manual tension adjustment in each replacement of different kind of threads, which has been regarded as indispensable in the conventional machines, (1) by means of disposing a means for imparting a suitable passing resistance, in a narrow gap formed on the thread path between a pair of plate members attached to the machine frame, to a thread passing therethrough in accordance with the surface condition of the thread in the course of passing, and (2) thereby enabling to automatically impart any thread passing through the two plate members an appropriate different tension in accordance with the kind of the thread. It greatly contributes to the simplification of the machine operation.

Further preferred embodiments of this invention completely eliminate the conventional troublesome adjustment operation of the tension given to the thread, by making the narrow gap between the two plate members into a substantially wedge shape for disposing the above-mentioned resistance imparting means in the wedge shaped gap, with a result of attaining capability of automatically imparting the thread a tension suitable for sewing, according to not only the thickness but also to the kind of threads. The machine operator can now thereby constantly make good-looking stitches without doing any of the troublesome adjusting operation conventionally needed.

What is claimed is:

1. A thread tensioning device for a sewing machine, comprising:

a pair of plate members mounted on the sewing machine in close confrontation to each other;

thread guide means for guiding thread to run between said plate members along a predetermined path;

urging means for producing pressure to urge one of said plate members toward the other for applying frictional resistance to movement of the thread running between said plate members;

gap forming means for forming a narrow gap, extending along said path, between said plate members, and resistance applying means is disposed in said gap to contact with the surface of the thread in said gap, for applying another resistance, which is independent of the frictional resistance due to said urging means, to movement of the thread in accordance with the condition of the thread surface, whereby the thread tension is automatically established in accordance with the kind of the thread running between said plate members.

2. A thread tensioning device according to claim 1, wherein said resistance applying means comprises a plurality of sharpened edge portions formed on at least one of said plate members.

3. A thread tensioning device according to claim 2, wherein at least one of said plate members is provided with a plurality of grooves, each extending at a substantially right angle to the thread path in said gap, and each of said sharpened edge portions extends between the thread engaging surface of said one plate member and a side surface of each of said grooves, said side surface being faced reverse to the thread running direction and being substantially perpendicular to said thread engaging surface.

4. A thread tensioning device according to claim 2, wherein at least one of said plate members is provided with a plurality of holes, and each of said sharpened edges is formed between the thread engaging surface of said one plate member and the inner surface of each of said holes.

5. A thread tensioning device according to claim 1, wherein said gap forming means includes at least one projection for forming said narrow gap against the action of said urging means.

6. A thread tensioning device for a sewing machine, comprising:

a pair of elongated rigid plate members mounted on the sewing machine, each having a thread engaging surface closely confronted to each other;

thread guide means for guiding thread running between said plate members;

urging means for concentratedly applying pressure at a fixed point on one of said plate members to urge said one plate member toward the other for providing frictional resistance to movement of the thread passing between said plate members;

gap forming means for forming a substantially wedge shaped extremely narrow gap, extending along the thread path, between said plate members, against said urging means, and resistance applying means formed on at least one of said plate members for contacting with the surface of the thread in said gap, during passing of the thread through said gap in order to produce resistance, which is independent of the frictional resistance provided by said urging means, to movement of the thread in accordance with the condition of the thread surface, whereby the thread tension is automatically established in accordance with the kind and the thickness of the thread passing through the wedge shaped gap between said plate members.

7. A thread tensioning device according to claim 6, wherein said resistance applying means comprises a plurality of sharpened edge portions formed on said one plate members.

8. A thread tensioning device according to claim 7, wherein said one plate member is formed with a plurality of grooves, each extending at a substantially right angle to the thread path etween said plate members, and each of said sharpened edge portions extends between the thread engaging surface of said one plate member and side surface of each of said grooves, said side surface being opposite to the thread advance direction and being substantially perpendicular to said thread engaging surface.

9. A thread tensioning device according to claim 6, wherein said gap forming means includes at least one projection disposed on one side of the thread path for contacting said plate members each other at the other side of the thread path, thereby forming the gap extending throughout the thread path.

10. A thread tensioning device according to claim 9, wherein said projection is manually operable for adjusting the height thereof.

* * * * *

UNITED STATES PATENT AND TRADEMARK OFFICE

CERTIFICATE OF CORRECTION

PATENT NO. : 4,246,857

DATED : January 27, 1981

INVENTOR(S) : GONNAI

It is certified that error appears in the above-identified patent and that said Letters Patent are hereby corrected as shown below:

Column 1, line 9, before "in" insert --on the occasion of each replacement thereof--, line 10, after "of" insert --replacement--, and delete "at each replacement thereof.", line 28, change "being" to --which is--, delete "a" and delete "work", line 30, change "a far" to --very--, and delete "work", line 33, change "applied by" to --issued to--, line 38, delete "a", line 44, change "above identified" to --above-identified--, line 45, before "the" insert --as applied to--, line 53, change "above" to --above-mentioned--, line 61, change "charge" to --change--, line 62, change "kind" to --kinds--;

UNITED STATES PATENT AND TRADEMARK OFFICE

CERTIFICATE OF CORRECTION

PATENT NO. : 4,246,857
DATED : January 27, 1981
INVENTOR(S) : GONNAI

It is certified that error appears in the above-identified patent and that said Letters Patent are hereby corrected as shown below:

Column 2, line 1, after "imparting" insert --to--, line 44, change "And" to --Furthermore--, line 60, change "And the" to --The--;

Column 3, line 8, before "thread" insert --replacement--, line 9, delete "replaced", line 12, change "will" to --are to--, line 13, change "this" to --the--, and before "in" insert --set out below--, line 14, change "appended" to --accompanying--, line 47, after "device;" insert --and--;

line 65, change "usually" to --conventionally--;

Column 4, line 12, change "And the" to --The--, line 23, change "will" to --is to--, line 30, delete "to" (second occurrence), line 31, before "the" insert --to--, line 38, change "And both" to --Both--;

UNITED STATES PATENT AND TRADEMARK OFFICE

CERTIFICATE OF CORRECTION

PATENT NO. : 4,246,857

DATED : January 27, 1981

INVENTOR(S) : GONNAI

It is certified that error appears in the above-identified patent and that said Letters Patent are hereby corrected as shown below:

Column 5, line 7, change "So" to --Consequently,--, line 23, before "in" insert --as viewed--, line 41, before "in" insert --as viewed--, line 62, change "will" to --is to--, line 68, change "So the" to --The--, Column 6, line 1, change "equivalently" to --consequently--, and before "coincides" insert --substantially--, line 11, change "will be" to --is--, line 22, change "equivalently" to --substantially--, line 23, change "far weak" to --much weaker--, line 39, change "And in" to --In--, line 47, change "will" to --is to--, line 53, change "the Figure" to Fig. 8--, line 57, change "So the" to --The--, line 59, before "a" insert --consequently--, line 65, change "And on" to --On--;

UNITED STATES PATENT AND TRADEMARK OFFICE

CERTIFICATE OF CORRECTION

PATENT NO. : 4,246,857

DATED : January 27, 1981

INVENTOR(S) : GONNAI

It is certified that error appears in the above-identified patent and that said Letters Patent are hereby corrected as shown below:

Column 7, line 23, change "will" to --would--, line 25, delete "a", (second occurrence) delete "matter", and after "and" insert --is--, line 37, change "acted" to --acting--, line 58, change "detailes" to --details--, line 59, change "will" to --is to--;

Column 8, line 46, change "so" to --consequently--, line 53, change "So" to --As a result,--;

Column 9, line 7, before "in" insert --, as viewed--, and after "2" insert --,--, line 51, delete "a" (second occurrence), line 52, change "And the" to --The--, line 53, change "earlier" to --above--, line 62, change "will" to --are to--;

Column 10, line 5, change "facing reverse" to --reversely faced--,

UNITED STATES PATENT AND TRADEMARK OFFICE

CERTIFICATE OF CORRECTION

PATENT NO. : 4,246,857

DATED : January 27, 1981

INVENTOR(S) : GONNAI

It is certified that error appears in the above-identified patent and that said Letters Patent are hereby corrected as shown below:

line 26, delete "of the", line 29, change "above described" to

--above-described--, line 30, after "251" insert --in each case--, line 38, delete "means of", line 39, change "And this" to --This--, line 40, before "to" insert --with respect--, and before "not" insert --and is--, Column 11, line 3, change "The" to --By practicing the present invention, the--, line 4, delete "thereby".

Signed and Sealed this

*Fifteenth* Day of *March 1983*

[SEAL]

*Attest:*

GERALD J. MOSSINGHOFF

*Attesting Officer*

*Commissioner of Patents and Trademarks*